US005642670A

United States Patent [19]

Takeuchi

[11] Patent Number: 5,642,670

[45] Date of Patent: Jul. 1, 1997

[54] PAPER SURFACE CLEANING DEVICE

[75] Inventor: Hideo Takeuchi, Chiba-ken, Japan

[73] Assignee: Comtec Co., Ltd., Japan

[21] Appl. No.: 404,371

[22] Filed: Mar. 15, 1995

[30] Foreign Application Priority Data

Mar. 18, 1994 [JP] Japan ..... 6-048904

[51] Int. Cl.[6] ..... B41F 35/02

[52] U.S. Cl. ..... 101/423; 101/424

[58] Field of Search ..... 101/423, 424, 101/424.1, 425, 416.1, DIG. 45

[56] References Cited

U.S. PATENT DOCUMENTS

| | | | |
|---|---|---|---|
| 623,629 | 4/1899 | Sackville et al. | 101/424 |
| 3,656,200 | 4/1972 | Riley | 101/425 |
| 3,842,735 | 10/1974 | Southam et al. | 101/425 |
| 3,892,663 | 7/1975 | Wiedenmann | 210/169 |
| 3,915,628 | 10/1975 | Bossard et al. | 101/425 |
| 4,836,129 | 6/1989 | Dahlgren | 101/424.2 |
| 4,836,142 | 6/1989 | Duback | 119/5 |
| 5,191,835 | 3/1993 | Blanchard | 101/148 |
| 5,289,774 | 3/1994 | Stanka | 101/416.1 |

FOREIGN PATENT DOCUMENTS

| | | | |
|---|---|---|---|
| 0203281 | 12/1986 | European Pat. Off. | 101/425 |
| 565510 | 4/1923 | France | 101/424 |
| 5193112 | of 1993 | Japan | B41F 23/00 |
| 7903999 | 11/1980 | Netherlands | 101/423 |

*Primary Examiner*—Edgar S. Burr
*Assistant Examiner*—Anthony H. Nguyen
*Attorney, Agent, or Firm*—Ladas & Parry

[57] ABSTRACT

A paper surface cleaning device for cleaning a surface of a printing paper running before being fed to a printing portion of a printing machine, which comprises a cleaning sheet having a water holding capacity in contact with the surface of the printing paper with a difference in running velocity between the printing paper and the cleaning sheet, a dampening roller which has, at its surface, a wettability so that water is attached to the surface of the dampening roller and which functions to push the cleaning sheet onto the surface of the printing paper, and a water pan into which the dampening roller is dipped partially. An even water film can be formed on the surface of the dampening roller to enable the cleaning sheet to get wet uniformly in its widthwise direction.

9 Claims, 3 Drawing Sheets

PAPER SURFACE CLEANING DEVICE

BACKGROUND OF THE INVENTION

This invention relates to a paper surface cleaning device for removing fine paper dusts, etc., from the surface of a printing paper.

A band-like printing paper is cleaned by a cleaning device before it is supplied to a printing portion of a printing machine. Such a cleaning device is disclosed in Japanese Laid-Open Publication HEI5(1993)-193112. The cleaning device has a diaphragm to be expanded and a compressed air source for expanding the diaphragm. The diaphragm is disposed opposite to a running path of the printing paper. Over and under the diaphragm are disposed a feeding roller and a take-up roller which make a running path of a cleaning cloth. The diaphragm pushes a portion of cleaning cloth to the printing paper running along its running path. Water is supplied by a water nozzle onto the cleaning cloth. The nozzle can supply water onto the cleaning cloth through its total width. The cleaning cloth gets wet with the water injected through the water nozzle, and the diaphragm is expanded to push the wet cleaning cloth to the printing paper thereby to wipe or clean the surface of the printing paper.

However, in the conventional paper surface cleaning device, since water is supplied to the cleaning cloth through the water nozzle, the wet state of the cleaning cloth is apt to be uneven in its widthwise direction, and the paper dusts cannot be removed uniformly from the printing paper in its widthwise direction. Furthermore, the wet state of the printing paper is uneven in its widthwise direction. It is necessary to change the amount of water to be supplied in accordance with the change of the running speed of the printing paper. However, in the conventional cleaning device having a nozzle as a damping device for dampening the cleaning cloth, such a control is remarkably difficult to decrease the quality in printing.

Thereupon, the inventor tried to make various experiments. For example, instead of the water nozzle for supplying water to the cleaning cloth, a brush was used. However, also in this case, an even water supply to the cleaning cloth could not be obtained. In general, in printing, dampening water is supplied by a dampening device to the outer circumferential surface of a cylinder together with ink. The dampening device comprises a water fountain roller dipped into the water in a water pan, a forme dampening roller, etc.. The inventor thought that the dampening device might be adapted for a water supply device to the surface of the cleaning cloth. In the conventional dampening device, damping water is finally supplied to a relatively stiff body such as a printing plate wound around the cylinder. In contrast, in the dampening water supply device for supplying damping water to the cleaning cloth, the cleaning cloth is not stiff body. Therefore, in a conventional dampening arrangement and a paper surface cleaning device, the objects to which the damping water supplied are different from each other. In these conditions, the inventor paid attention to the fact that a roller could push effectively the cleaning cloth onto the printing paper and could be rotated at a predetermined speed.

SUMMARY OF THE INVENTION

It is an object to provide a paper surface cleaning device which can remove evenly fine paper dusts, or fine paper wastes, etc., from the surface of a printing paper while pushing a cleaning sheet onto the surface of the printing paper.

According to this invention, there is provided a paper surface cleaning device for cleaning or wiping off foreign matters such as fine paper dusts or paper wastes on a surface of a printing paper which comprises a cleaning sheet which runs along a running path of the printing paper so as to be in contact with the surface of the printing paper with a difference in velocity between the running paper and the cleaning sheet, roller means for absorbing water to form a water film on a surface of the roller means and pushing the cleaning sheet to the surface of the printing paper while supplying the water film to the printing paper, the roller means being disposed so as to be moved away and toward the surface of the printing paper and having, at its surface, a wettability, feeding means for feeding the cleaning sheet, and a water pan for accommodating damping water into which the roller means is dipped.

The dampening roller is rotated in the water pan to form a water film thereon and, at the same time, is in contact with the cleaning sheet. The dampening roller has a proper wettability, and the water supplied to the surface of the dampening roller from the water pan is spread evenly onto the surface of the dampening roller. The cleaning sheet in contact with the dampening roller has a water-holding capacity to absorb a water film from the surface of the dampening roller, and the water film absorbed therein is thinly and evenly immersed into the cleaning sheet through its total width. In this manner, since the wet state of the cleaning sheet becomes even in its widthwise direction, the removal of the fine paper dusts from the printing paper and the wetting of the printing paper are performed evenly in the widthwise direction of the printing paper when the cleaning sheet is pushed to the printing paper. This printing paper treated in such a manner causes to improve the quality in printing. In case that the water fountain roller is in contact with the forme dampening roller, and the water fountain roller is dipped into water in the water pan, an even water film is formed on the outer surface of the water fountain roller, and more even water film is formed on the surface of the forme dampening roller to be transferred to the cleaning sheet. Therefore, the water attached to the printing paper can be controlled more concisely. In this case, if the rotational number of the water fountain roller is determined in accordance with the change of the running speed of the printing paper, the amount of water attached to the printing paper can be kept constant irrespective of the running speed of the printing paper.

Furthermore, in case that the intermediate roller provided between the water fountain roller and the forme dampening roller, a constant water film is formed on the water fountain roller, and on the intermediate roller in contact with the water fountain roller, a thinner water film is formed. Further, a more thinner even water film is formed on the outer surface of the forme dampening roller to be transferred to the cleaning sheet. The water attached to the printing paper is more concisely adjusted.

In case that the cleaning sheet is in the form of mesh, paper dusts, etc., wiped off from the printing paper are held in the meshes. The surface of the forme dampening roller is in contact with the cleaning sheet with a difference in velocity between the running speed of the cleaning sheet and the rotational speed of the forme dampening roller. Accordingly, the paper dusts wiped off from the cleaning sheet can be recovered without being attached onto the surface of the forme dampening roller.

Further, in this invention, in case that the paper surface cleaning units are disposed on both sides of the printing paper, and that only one side of the printing paper is printed, the water fountain roller, the forme dampening roller or the intermediate roller on the cleaning unit provided on the non-printed side of the printing paper is rotated faster than those rollers on the cleaning unit provided on the printed side of the printing paper so that the same amount of water is attached to the non-printed side of the printing paper and the printed side thereof. This results in prevention of curling of the printing paper.

Further objects, features and other aspect of this invention will be understood from the following detailed description of the preferred embodiments of this invention with reference to the drawings.

PREFERRED EMBODIMENTS OF THE INVENTION

Some preferred embodiments will now be explained with reference to the drawings.

Embodiment 1

Figure 1:
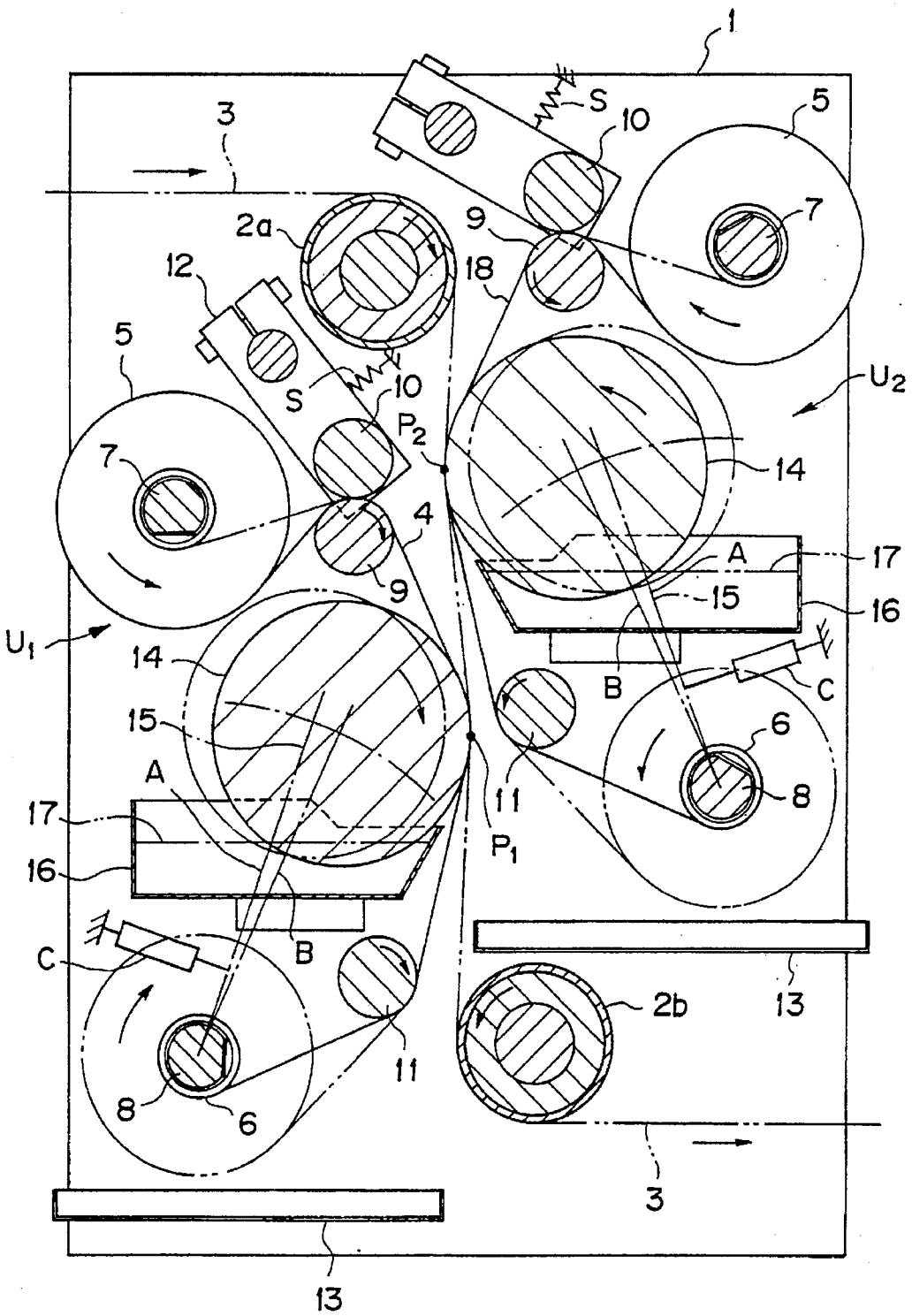
FIG. 1 is a schematic view for showing a first embodiment of a paper surface cleaning device according to this invention.

A paper surface cleaning device according to this invention is provided between a roll paper supply portion of a printing machine for printing a rolled paper and a printing portion thereof, and supported by left and right fixed frames 1,1 (one of them is shown in FIG. 1) which are provided over left and right frames (not shown) of the printing machine. Two guide rollers 2*a*, 2*a* are bridged between the left and right fixed frames 1 parallel with various rollers of the printing machine so as to contact the opposite surfaces of a printing paper 3, respectively. The guide rollers 2*a* are disposed separately in the vertical direction to form a vertical running path of the printing paper. The printing paper 3 runs at, e.g., a speed of 20 to 600 meters per minute in the direction indicated by arrows to be printed at the printing portion of the printing machine.

Two cleaning units $U_1$, $U_2$ are provided on the fixed frames 1, 1. The cleaning unit $U_1$ is provided on one side of the printing paper 3, and the cleaning unit $U_2$ is provided on the other side of the printing paper 3. The cleaning unit $U_1$ comprises a band-like cleaning sheet 4 which contacts one surface of the printing paper 3 between the two guide rollers 2*a*, 2*b* in order to wipe or clean the surface of the printing paper 3. The cleaning sheet 4 runs in the same direction as the running direction of the printing paper between a feeding roll 5 for supplying the cleaning sheet 4 and a take-up roll 6 for winding up the cleaning sheet 4. The feeding roll 5 and the take-up roll 6 are disposed separately in the vertical direction, and rotatably and detachably supported by two support shafts 7, 8, respectively. The support shaft 7 of the feeding roll 5 is rotatably supported on the fixed frames 1, 1 through a friction clutch not shown in the drawing, and the take-up roll 6 is driven by a driving force transmitted from a motor, a sprocket, a chain, a friction clutch, etc. (not shown). Along a running path of the cleaning sheet 4 are disposed a driving roll 9 cooperating with a pushing roll 10 and provided on upstream side of the dampening roller 14 with respect to a running path of the cleaning sheet 4, a dampening roller 14 for absorbing damping water to dampen the cleaning sheet and pushing the cleaning sheet onto the one surface of the printing paper 3 to wiping off fine wastes or paper dusts from the surface of the printing paper, and a guide roll 11 for adjusting the tension of the cleaning sheet 4. The driving roll 9 has, at its end, an arm which is reciprocatingly moved by an air cylinder so as to be rotated intermittently. The driving roll 9 may be controlled by a servo motor. Thus, the cleaning sheet 4 is fed from the feeding roll 5 toward the take-up roll 6 little by little. The pushing roll 10 is urged by a spring S provided between an arm 12 for supporting the pushing roll 10 and the fixed frame 1 toward the driving roll 9 all the time. The cleaning sheet 4 is fed at a predetermined pitch from the feeding roll 5 toward the take-up roll 6 while being held between the driving roll 9 and the pushing roll 10. While the driving roll 9 is stopped, the support shaft 8 for the take-up roll 6 runs idle through a friction clutch (not shown) with respect to the take-up roll 6. Accordingly, the take-up roll 6 pulls the cleaning sheet 4 all the time to prevent its loosening. A dust pan 13 is provided under the take-up roll 6 to receive fine waste dusts, water, etc., dropped from the cleaning sheet 4 or the like.

The dampening roller 14 is connected with a driving force through a chain and a sprocket or the like to be rotated, e.g., at a low speed of 5 to 30 meters per minute in the direction indicated by an arrow, that is, in the clockwise direction or in the running direct of the printing paper. The running speed of the printing paper 3 is faster than that of the cleaning sheet 4 to generate a rubbing between the cleaning sheet 4 and the printing paper 3. The number of rotation of the dampening roller 14 may depend upon the running speed of the printing paper 3 to keep the amount of water attached to the surface of the printing paper constant irrespective of the change of the printing paper 3. The dampening roller 14 is rotatably supported by an arm 15 which is swingably supported on an extension of the support shaft 8 of the take-up roll 6 and which is swung by an air cylinder C provided between the arm 15 and the fixed frame 1 to make the cleaning sheet 4 contact the printing paper 3 and separate the cleaning sheet 4 therefrom.

The dampening roller 14 has, at its surface, a wettability. The outer surface of the dampening roller 14 is plated with chromium so that water in a water pan 16 is apt to attach on the surface of the dampening roller 14. In addition to chrome plating, other means such as copper plating, nickel plating, linning of resin, etc., can be performed on the surface of the dampening roller 14 to provide a wettability thereto. The dampening roller 14 is dipped partially into the water in the water pan 16 disposed thereunder. The water 17 overflows from the water pan 16 at a predetermined level to maintain the surface of the water in the water pan 16 constant. Therefore, a predetermined amount of water is attached to the outer surface of the dampening roller 14.

The cleaning sheet 4 is preferably made of mesh-like non-woven fabric having a water-holding capacity. Therefore, the cleaning sheet 4 having a water-holding capacity holds a predetermined amount of water supplied from the water pan 16 to wipe or clean the surface of the printing paper 3 in a state wherein the cleaning sheet is wet. Further, since the cleaning sheet 4 is formed of meshes having lattice-like spaces, it can catch fine dusts or the like in the meshes. As material of the non-woven fabric, cellulose series fabric may be used. Instead of the non-woven fabric, cotton cloth, victoria lawn or the like can be used.

The cleaning unit $U_2$ provided on the opposite surface of the printing paper 3 between the guide rollers 2*a*, 2*b* has another cleaning sheet 18 for wiping or cleaning the other surface of the printing paper. The cleaning sheet 18 is pushed by a dampening roller 14 toward the other side of the printing paper. The cleaning unit $U_2$ is disposed deviately upward from the cleaning unti $U_1$ so that a pushing point $P_2$ at which the printing paper 3 is pushed by the dampening roller 14 of the unit $U_2$ is deviate upward from a pushing point $P_1$ at which the printing paper 3 is pushed by the dampening roller 14 of the unit $U_1$. The two dampening roller 14, 14 are disposed to push the printing paper in directions opposite to each other to ensure reliable contacts between the printing paper 3 and the cleaning sheets 4. Since the cleaning unit $U_2$ has the same structure as that of the cleaning unit $U_1$, the same members are indicated by the same numbers to omit detailed explanations.

The operation of the above paper surface cleaning device will now be explained.

When the printing machine is started to operate, the printing paper 3 starts to run. When the running speed of the printing paper reaches, e.g, approximately 50 meters per minute, the dampening rollers 14, 14 of both cleaning units $U_1$ $U_2$ are rotated by a driving motor (not shown) in the direction indicated by the arrows. The dampening rollers 14 are rotated in the water pans 16, 16 to form water films on the outer surfaces thereof, and the water films are transferred to the cleaning sheets 4, 18, respectively. The water film on each dampening roller 14 is formed at a uniform thickness, and, therefore, each of cleaning sheets 4, 18 includes water evenly. Since the rotational number of the dampening roller 14 is changed in accordance with the running speed of the printing paper 3, the amount of water attached to the outer surface of each dampening roller 14 is maintained constant irrespective of the change of the running speed of the printing paper 3. Successively, the arm 15 for supporting each dampening roller 14 is swung from a rest position A to an operating position B to push each of the cleaning sheets 4, 18 onto the surface of the printing paper 3. Thus, the both surfaces of the printing paper 3 are cleaned or wiped by the cleaning sheets 4, 18 to remove paper dusts attached to the surfaces of the printing paper 3 therefrom and, at this time, a proper amount of water is supplied on the surfaces of the printing paper 3. The surface of each dampening roller 14 has a proper wettability, and water attached onto the surface of the dampening roller 14 is spread to form a uniform thin film thereon. Each of the cleaning sheets 4, 18 has a water-holding capacity, the water absorbed in outer surface of the dampening roller 14 is immersed evenly into each of the cleaning sheets 4, 18 to the extent of total width of the cleaning sheets 4, 18. In this manner, the wet state of the cleaning sheets 4, 18 is even in its widthwise direction, and, therefore, paper dusts or fine wastes on the printing paper can be completely removed and the printing paper is wetted evenly when the printing paper 3 is wiped or scrubbed by the cleaning sheets 4, 18 because of rubbing therebetween due to a difference in running speed therebetween in the same direction. Further, the cleaning sheets 4, 18 absorb fine wastes or dusts of paper on the surface of the printing paper through the water held in the cleaning sheets 4, 18. The paper fine wastes or dusts become a state of slurry to be caught in meshes of the cleaning sheets 4, 18 and to be transferred to the take-up rolls 6, 6. The fine paper wastes or dusts are caught in the meshes of the cleaning sheets 4, 18 and the dampening rollers 14 contact the cleaning sheets 4, 18 while rotating. Therefore, the fine paper wastes or dusts can be recovered together with the cleaning sheets without attachment of the wastes or dusts onto the outer surface of the dampening rollers 14. This increases accuracy of registration of printing to wipe or clean the surface of the printing paper by the cleaning sheets 4, 18. That is, the rolled printing paper normally has a moisture content of 5%, and the running paper absorbs moisture in the atmosphere thereby to extend gradually as time goes by. In the case of an offset printing, the printing paper passes through a black color printing unit, a red color printing unit, an indigo color printing unit and a yellow color printing unit to be printed with each color in order. At this time, damping water is attached to the printing paper in order during printing at each color printing unit to extend gradually together with absorption of moisture in the atmosphere. Therefore, a shear in printing is generated to decrease the quality of printing. In this invention, water is attached to the printing paper by the cleaning units $U_1$, $U_2$ to be extended or lengthened beforehand before the printing paper reaches the printing portion of a printing machine. This can effectively prevents a false registration in printing. Thereafter, the printing paper 3 is fed to the printing portion of the printing machine to be printed.

In case that the running speed of the printing paper is decreased or the printing paper is stopped running due to the interruption of printing or other accidents, the air cylinders C,C of the units $U_1$, $U_2$ are operated to separate the dampening rollers 14 and the cleaning sheets 4, 18 from the surfaces of the printing paper 3 and to stop the rotation of the dampening rollers 14. At the same time, the supply of water to the cleaning sheets 4, 18 is stopped to prevent the cleaning sheets 4, 18 from getting wet excessively. In case that only one surface of the printing paper 3 is printed, only one of the cleaning unit $U_1$, $U_2$ may be operated. However, even in case that only one surface of the printing paper 3 is printed through an offset printing operation, the two cleaning units $U_1$, $U_2$ may be used to prevent the printing paper 3 from being curled. That is, the surface of the printing paper, to be printed is wet by attachment of dampening water, and the opposite surface, of the printing paper, not to be printed is dry because of no attachment of dampening water. This causes generation of curling of the printing paper 3. In this case, the dampening roller or various rollers such as a dampening roller and a roller contacting a cylinder on the side to be printed are rotated more rapidly than those on the side not to be printed to compensate for lack of damping water on the side to be printed. Thus, both surfaces of the printing paper are wet at the same level to prevent the generation of the curling of the printing paper 3.

Embodiment 2

Figure 2:
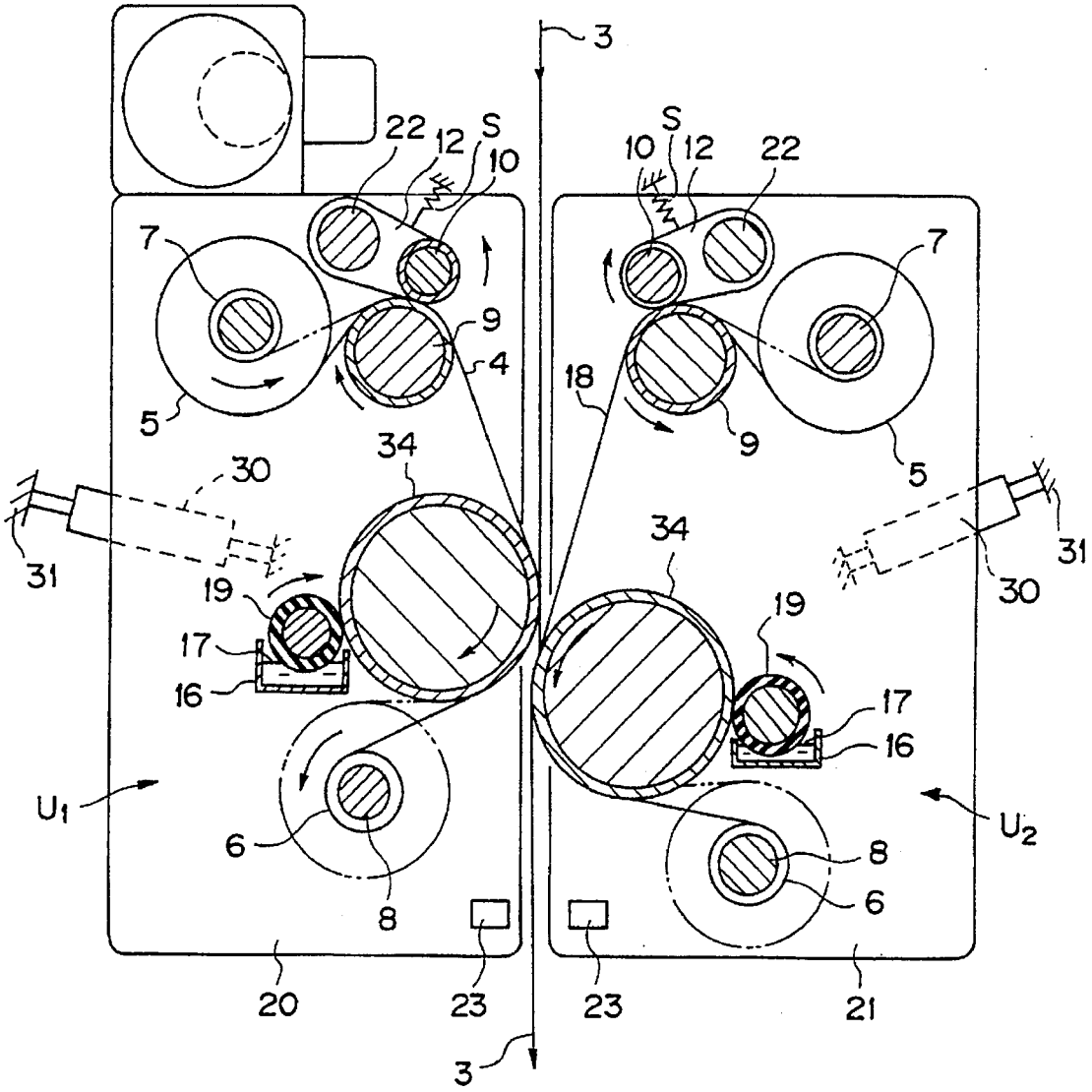
FIG. 2 is a schematic view for showing a second embodiment of the paper surface cleaning device according to this invention.

As shown in FIG. 2, the forme dampening roller 34 contacts a water fountain roller 19 which is partially dipped into water in the water pan 16. The water fountain roller 19 has a rubber layer at its outer surface. The water fountain roller 19 is rotated in the same direction as that of the forme damping roller 34 to generate a difference in there peripheral speed. The rotational number of the water fountain roller 19 is determined in accordance with the change of the running speed of the printing paper 3 so that the amount of water attached to the printing paper is kept constant irrespective of the running speed of the printing paper 3. The water 17 in the water pan 16 is attached to the surface of the water fountain roller 19 to form thereon a water film of a predetermined thickness, and the water film on the outer surface of the water fountain roller 19 is spread between the water fountain roller 19 and the forme dampening roller 34 to form an even and thin water film on the forme dampening roller 34. The water film on the forme dampening roller 34 is transferred to the cleaning sheets 4, 18.

In this embodiment, the cleaning unit $U_1$ for wiping the front surface of the printing paper 3 is formed on a frame 20, and the cleaning unit $U_2$ for wiping the back surface of the printing paper 3 is formed on a frame 21 which is separately disposed from the frame 20. The two frames 20, 21 are opposed to each other.

In addition to a feeding 5, a take-up roll 6, the dampening roller 34, etc., each of the units $U_1$, $U_2$ has an arm 12 for supporting a pushing roll 10. The arm 12 is pivotably supported by a shaft 22 which is extended to the two left and right frames of the printing machine to be supported thereby at its both ends. That is, the shafts 22, 22 also function as two supporting points for the frames 20, 21. The frames 20, 21 are moved by two air cylinders 30 provided between the frames 31, 31 of the printing machine and the frames 20, 21, respectively. Each of the frames 20, 21 is rotated around each of the shafts 22, 22 by the operation of each air cylinder 30 thereby to determine contact positions of the forme dampening rollers 34, 34 with respect to the printing paper 3 through the cleaning sheets 4, 18. Under each of the forme dampening rollers 34, 34 are provided a pair of air nozzles 23, 23 which are opposed to each other in order to dry the surfaces of the printing paper 3 to remove excessive water on the printing paper 3 by blowing hot air thereonto. In FIG. 2, components of this embodiment designated with the same reference characters as FIG. 1 are identical with the corresponding elements shown in FIG. 1, and the description for them will not be repeated.

The air nozzles 23, 23 may be disposed in the first embodiment.

Embodiment 3

Figure 3:
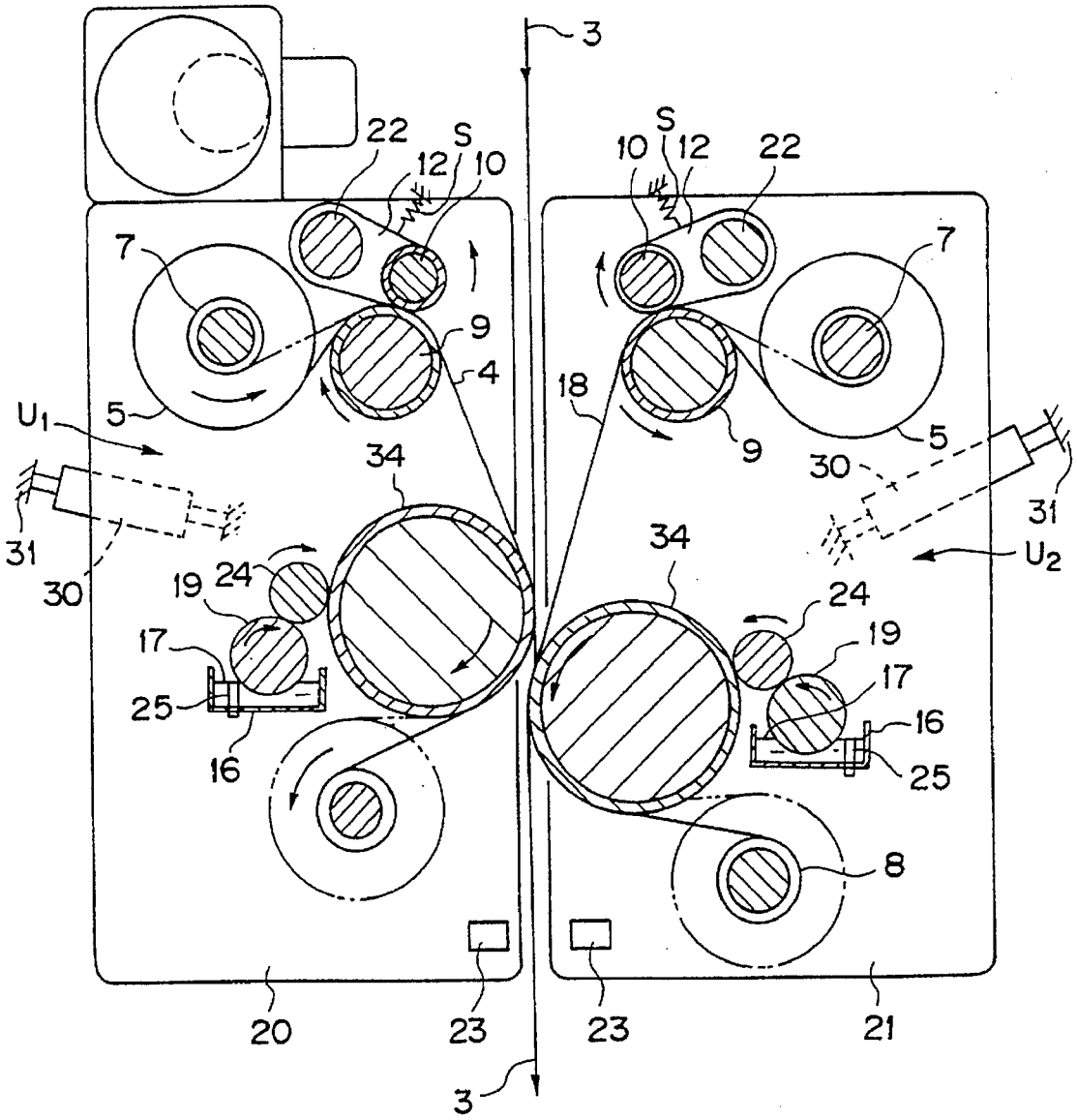
FIG. 3 is a schematic view for showing a third embodiment of the paper surface cleaning device according to this invention.

As shown in FIG. 3, an intermediate roller 24 is provided between the water fountain roller 19 and the forme dampening roller 34 to contact both surfaces of the forme dampening roller 34 and the water fountain roller at the same time. The water fountain roller 19 is dipped into the water in the water pan 16. In this case, the surfaces of The forme dampening rollers 34, 34 and the water fountain rollers 19 are plated with chromium having a wettability and the surface of the intermediate roller 24 is covered with rubber. The water pan 16 has a drain pipe 25 therein for keeping water level constant. The rotational numbers of the water fountain rollers 19, 19 and the intermediate rollers 24, 24 are determined in accordance with the change of the running speed of the printing paper 3 to keep constant the amount of water attached to the printing paper irrespective of the change of the running speed of the printing paper. The water in the water pan 16 is attached to the surface of the water fountain roller 19 to form thereon a water film of a predetermined thickness. The water film on the water fountain roller 19 is transferred to the intermediate roller 24 to form a thinner water film which is transferred to the surface of the forme dampening roller 34 to form a much thinner even water film which is transferred to the cleaning sheets 4, 18.

The rotational directions of three roller 19, 24, 34 are the same. The drain pipe 25 may be disposed in the water pan 16 in the first and second embodiments, respectively.

In FIG. 3, components of this embodiment designated with the same reference characters as FIG. 2 are identical with the corresponding elements shown in FIG. 2, and the description for them will not be repeated.

According to this invention, roller means for absorbing the water and dampening the cleaning sheets 4, 18 while pushing the cleaning sheets 4, 18 onto the printing paper 3 has a wettability and the cleaning sheet has a water-holding capacity. Therefore, each cleaning sheet gets wet evenly in its widthwise direction. Accordingly, paper dusts or the like can be effectively removed from the surface of the printing paper 3, and the printing paper gets wet uniformly in its widthwise direction to increase quality in printing. If the rotational number of the roll means is determined in accordance with the change of the running speed of the printing paper 3, the amount of water attached to the printing paper 3 can be maintained constant irrespective of the running speed of the printing paper 3.

What is claimed is:

1. A paper surface cleaning device for cleaning or wiping off foreign matters such as fine paper dusts or paper wastes on a surface of a printing paper which comprises:

a) a cleaning sheet which is in contact with the surface of the printing paper and which comprises band-like cloth having meshes which have a water holding capacity:

b) roller means for absorbing water to form a water film on a surface of the roller means and for pushing the cleaning sheet to the surface of the printing paper while supplying the water film to the cleaning sheet, the roller means having, as its surface, a wettability;

c) feeding means for feeding the cleaning sheet along a running path of the printing paper with a velocity different from that of the printing paper; and d) a water pan for accommodating dampening water into which the roller means is dipped.

2. A paper surface cleaning device according to claim 1, wherein the paper surface cleaning means comprises two cleaning units each having the cleaning sheet, the roller means, the feeding means and the water pan, one of the cleaning units being disposed on a front surface of the printing paper, the other unit of the cleaning units being disposed on a back surface thereof in a state wherein the roller means of one unit is in contact with a position on the printing paper, deviated from a contact position of the roller means of the other unit.

3. A paper surface cleaning device according to claim 1, wherein the roller means comprises a dampening roller supported by a swingable arm.

4. A paper surface cleaning device according to claim 1, wherein the feeding means comprises a feeding roll for supplying the cleaning sheet, a take-up roll for taking-up the cleaning sheet after the cleaning sheet wipes off paper dusts from the surface of the printing paper, a driving roller disposed on upstream side of the roller means to feed the cleaning sheet intermittently, and a pushing roller for cooperating with the driving roller to feed the cleaning sheet together with the driving roller.

5. A paper surface cleaning device according to claim 2, wherein the cleaning units are held by two swingable frames, respectively, opposed to each other, the roller means comprising a water fountain roller dipped into the water in the water pan and a forme dampening roller contacting the water fountain roller, the forme dampening roller pushing the cleaning sheet onto the printing paper.

6. A paper surface cleaning device according to claim 1, further comprising an air nozzle for drying the printing paper on downstream side of a contact position between the cleaning sheet and the printing paper.

7. A paper surface cleaning device according to claim 1, wherein the water pan has a drain pipe therein for keeping constant water level in the water pan.

8. A paper surface cleaning device according to claim 1, wherein the roller means comprises a water fountain roller dipped into the water in the water pan, a forme dampening roller pushing the cleaning sheet onto the printing paper, and an intermediate roller provided between the forme dampening roller and the water fountain roller.

9. A paper surface cleaning device according to claim 1, wherein the feeding means feeds the cleaning sheet toward the same direction as that of the printing paper.

* * * * *